United States Patent [19]

Best et al.

[11] 4,386,510

[45] Jun. 7, 1983

[54] KEY-CHANGEABLE LOCK CORE

[75] Inventors: Walter E. Best; William R. Foshee, both of Indianapolis, Ind.

[73] Assignee: Best Lock Corporation, Indianapolis, Ind.

[21] Appl. No.: 239,436

[22] Filed: Mar. 2, 1981

[51] Int. Cl.[3] ..... E05B 27/04

[52] U.S. Cl. ..... 70/369; 70/373

[58] Field of Search ..... 70/369, 368, 367, 340, 70/364 A, 373

[56] References Cited

U.S. PATENT DOCUMENTS

| | | | |
|---|---|---|---|
| 1,561,771 | 11/1925 | Best | 70/364 |
| 2,814,941 | 12/1957 | Best | 70/340 |
| 3,206,958 | 9/1965 | Best | 70/369 |
| 3,667,264 | 6/1972 | Surko et al. | 70/369 |
| 4,123,926 | 11/1978 | Elder | 70/369 |

OTHER PUBLICATIONS

Drawing of Medeco Removable Core.

*Primary Examiner*—Robert L. Wolfe

*Attorney, Agent, or Firm*—Barnes & Thornburg

[57] ABSTRACT

A key-changeable lock core of FIG. 8 cross section has a core body with key plug and pin tumbler housings, and a key plug supported for rotation in the key plug housing. A control element, desirably a sleeve about the key plug having a thick top segment carrying a core-retaining lug, is mounted in a core-body recess for rotation between a core-locking position and a lug-retracted position. Its inner face defines an operating shear line at the surface of the key plug, and its outer face defines a control shear line at the top face of the recess, which is preferably a flat planar face. The outer face of the control element has an arcuate portion in the vicinity of the pin tumbler barrels on a radius of curvature about the axis of the control element, and has a planar face portion extending toward the retaining lug in diverging relation with such curvature, preferably tangentially therefrom. Such planar face moves against a lateral portion of the top face of the recess as a stop to stop the control element in its lug-retracted position, and the outward divergence of the planar face provides that the lug and its supporting structure extend radially beyond the radius of curvature of the arcuate outer face portion of the control element to increase their cross section and core-retaining strength. Preferably, a second planar face on the control element moves against the top face of the recess to provide stop means for such element in its core-locking position.

12 Claims, 7 Drawing Figures

FIG. 1
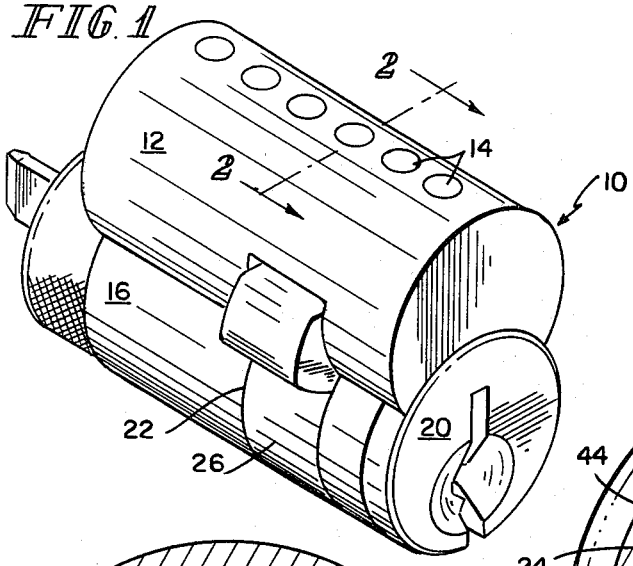
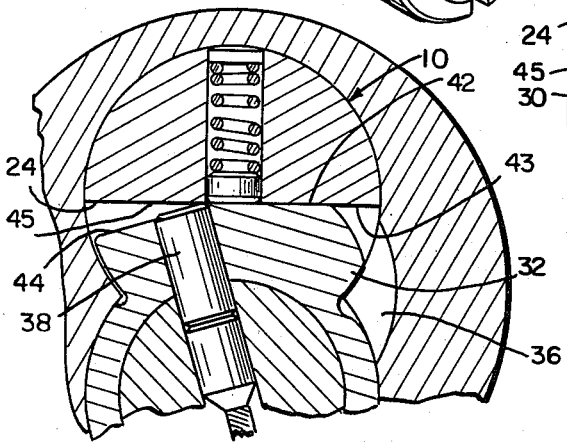
FIG. 3
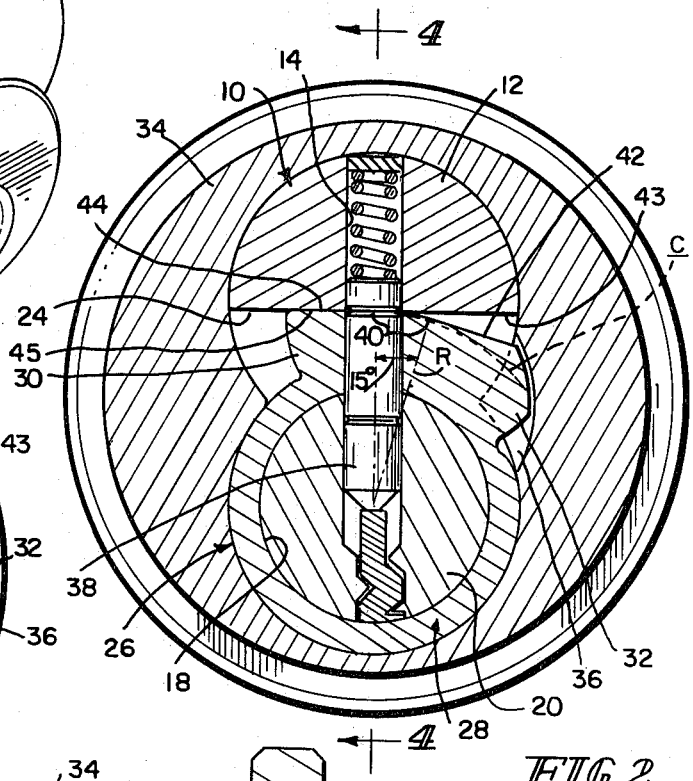
FIG. 2
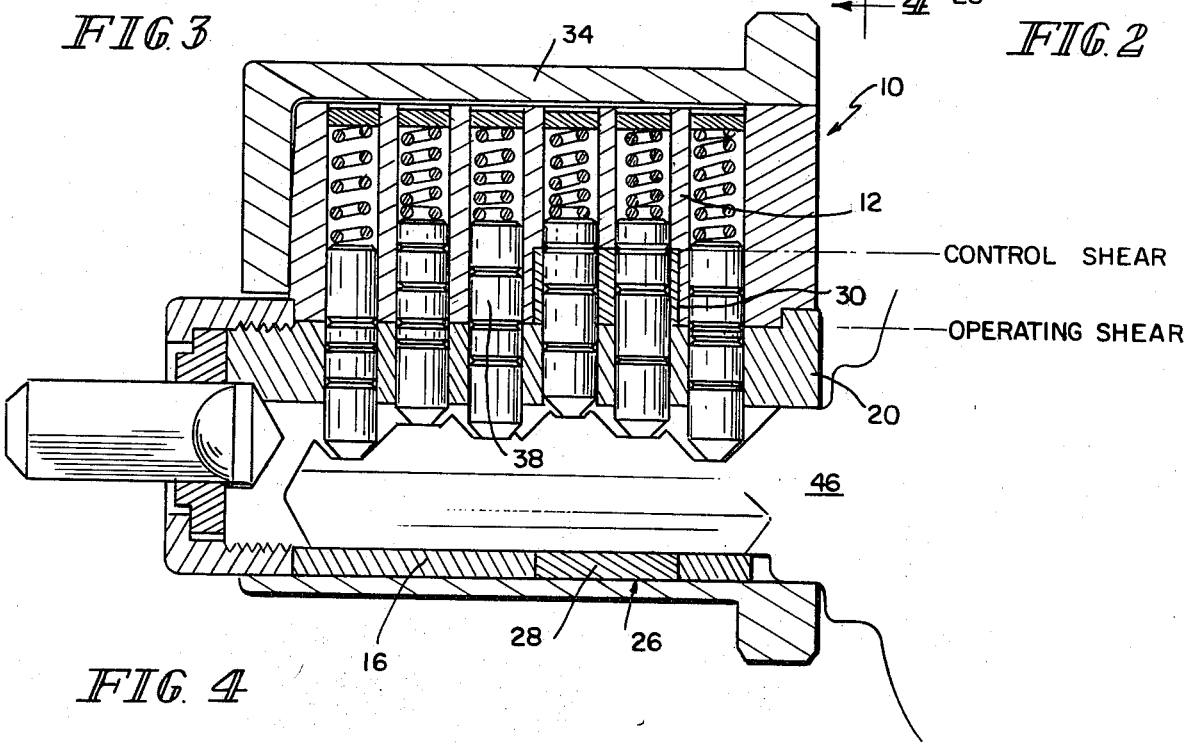
FIG. 4

KEY-CHANGEABLE LOCK CORE

This invention relates to a key-changeable or key-removable lock core for use in a lock cylinder, door-knob, or other core receptacle.

Key-removable and lock cores are known, for example, from F. E. Best U.S. Pat. No. 1,561,771. Such cores have been developed and used in a standard configuration and size, substantially as shown in F. E. Best U.S. Pat. No. 3,206,958, so as to be readily interchangeable and renewable in the same lock mechanisms. The standard lock core includes a core body of FIG.-8 cross section with both a key plug and a full-length thin-walled control sleeve within its bottom lobe. The sleeve has a thick top segment over its full length, and the top lobe of the body is axially broached to form a recess to receive such segment and limit rotative movement of the control sleeve. The inner cylindrical face of the sleeve lies in rotatable engagement with the outer surface of the key plug and forms an operating shear line therebetween which permits the key plug to be rotated by a suitable key for operation of a secondary mechanism. The outer surface of the thick top segment is a curved surface on a radius of curvature about the axis of rotation of both the key plug and the sleeve. The sleeve segment carries a core-retaining lug which projects laterally from that segment in a circumferential direction and lies wholly within the radius of curvature of the outer cylindrical surface of the sleeve segment. The core body is cut away at one side to permit the lug to be rotated to a projected position for engagement behind a shoulder in the core-receiving receptacle, and the lug is retractable to within the profile of the core body by rotation of the sleeve and the core plug together by use of a special control key. This arrangement limits the size and cross section of the retaining lug, and hence limits the strength with which it locks the core in position. Also, this arrangement requires that a side opening through which the retaining lug is projected must be cut through the wall of the figure-8 core body by an axial boring operation from the rear, which is relatively difficult to carry out and control, and weakens the core body.

It is the object of the present invention to increase the cross-sectional area and strength of the retaining lug and its supporting structure, to provide an improved form of control element and improved relation between such element and a core body, including improved stop means for the control element, and to do so in a manner which simplifies the manufacturing operations. Further, in a preferred embodiment of the present invention, instead of supporting the lug-carrying segment on a full-length, thin-walled sleeve, such segment is supported on a shorter sleeve so that the side walls of both the sleeve and the key plug lobe of the core body can be of full thickness.

In accordance with the invention, the core body has both key plug and pin tumbler housings and is desirably of figure-8 cross section. A key plug is supported for rotation in and with respect to the key plug housing, and a control element carrying a core-retaining lug is arranged for limited rotation with the key plug and relative to the core body between a normal core-locking position and a lug-retracting position. The control element, which may be in the form of a sleeve, has an inner cylindrical face confronting the surface of the key plug and defining an operating shear line between itself and such key plug, and has an outer face confronting a face on the pin tumbler housing and defining a control shear line therebetween. The series of pin tumbler barrels in the pin tumbler housing extends therefrom in alignment through said control element and into the key plug when such element and key plug are in their normal locking positions. The outer face of the control element has an arcuate portion in the vicinity of the pin tumbler barrels which is substantially on a radius of curvature about the axis of rotation of the control element, and has a planar portion extending laterally toward the retaining lug in a radially outward spaced relation and preferably in diverging relation, for example, a tangential relation, with respect to such curvature. This causes the control element and lug to extend radially beyond such radius of curvature to increase the cross section and strength thereof.

The control element is desirably mounted in a recess in the pin tumbler housing, and such recess has a top face which forms a shear line-defining portion in the vicinity of the pin tumbler barrels and has a stop face extending laterally from the shear line-defining portion, generally in the same direction as the planar face portion of the control element, but normally spaced and diverging therefrom, against which such planar face portion of the control element moves as a stop when the control element is moved to lug-retracting position. Stop means is provided for stopping the control element when the same is moved to its core-locking position. Such stop means preferably comprises a stop-face portion on the control element at the opposite side of the arcuate face portion from the first planar portion and at an angle to such planar portion, which moves against a confronting stop face on the core body when the control element is moved to core-locking position. Preferably, the two stop faces on the core body are formed as coplanar surfaces, and the shear line-defining portion of the pin tumbler housing may be an intermediate portion of the same planar surface. This permits the recess to be formed in the core body by a straight-through milling or cutting operation. The stop faces on the body and control element may, however, be located at small distances or angles from the positions described, as for purposes of further increasing the cross section of the lug and its supporting structure. Also, the shear line-defining portion of the pin tumbler housing face may be an arcuate concave surface matching the arcuate convex surface of the control element.

The accompanying drawings illustrate the invention, and show a preferred embodiment exemplifying the best mode of carrying out the invention as presently perceived, and also showing certain modifications thereof. In such drawings:

FIG. 1 is a perspective view of a key-removable core in accordance with the invention;

FIG. 2 is a transverse section taken on the line 2—2 of FIG. 1, showing the core locked in a lock cylinder forming a receptacle therefor;

FIG. 3 is a transverse section like that of FIG. 2, showing the core in unlocked position;

FIG. 4 is a section taken on the line 3—3 of FIG. 2;

Figure 5:
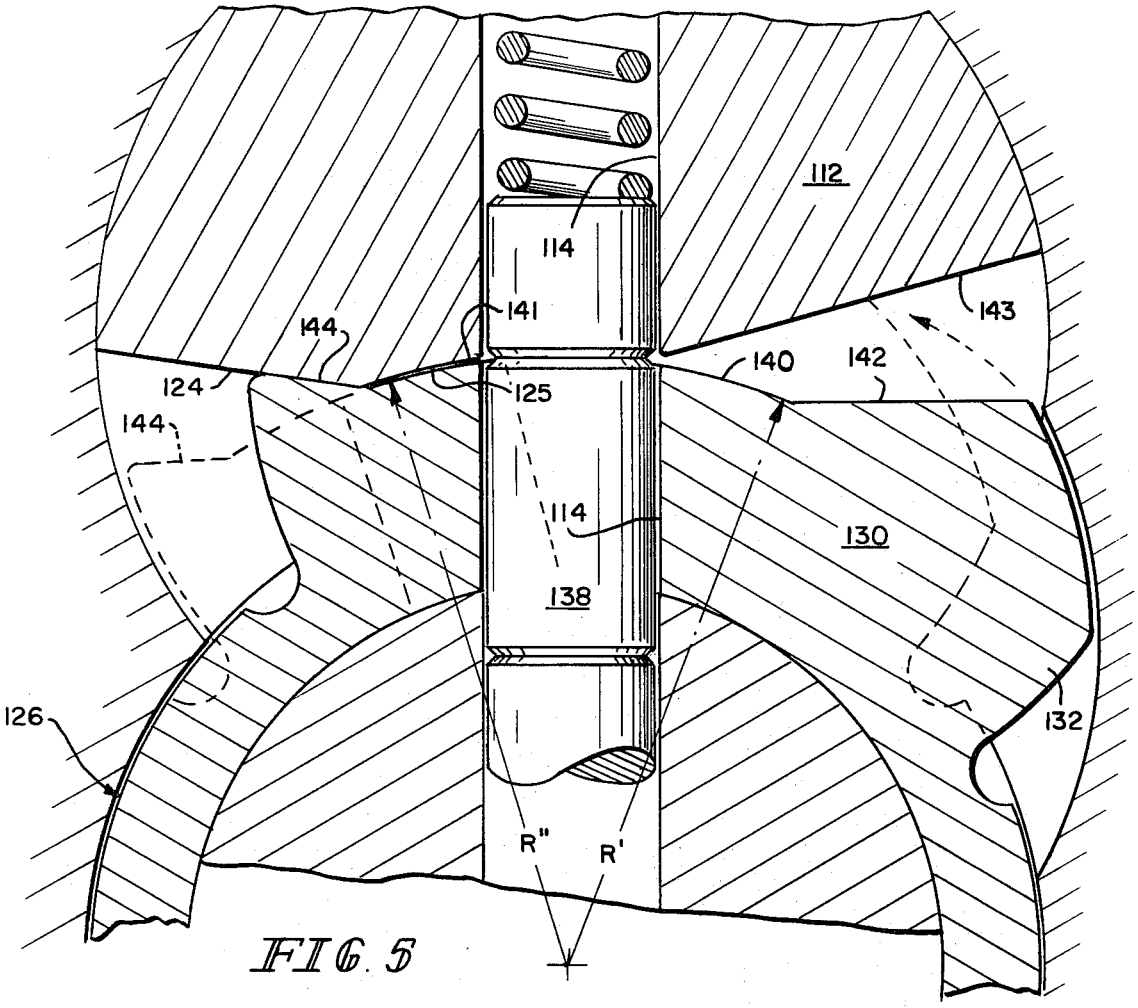
FIG. 5 is an enlarged transverse section like that of FIG. 2, but showing two modifications, namely, further enlargement of the core-retaining lug, and variation of the stop means.

The core shown in FIGS. 1–4 comprises a core body 10 of figure-8 cross section having an upper lobe forming a pin tumbler housing 12 with an axial series of pin tumbler barrels 14 formed therein. The core also has a lower lobe forming a key plug housing 16 and containing an axial bore 18 in which a key plug 20 is rotatably mounted. Intermediate the ends of the key plug housing, the core is cut transversely to form a recess 22 which extends upward into the lower portion of the pin tumbler housing 12. In this embodiment, the top surface of the recess 22 is a flat planar surface 24 normal to a plane containing the axes of the two lobes 12 and 16, and parallel with such axes.

The recess 22 contains a control element 26 having a cylindrical lower portion 28 coaxial with the lower lobe 16 and its key plug bore 18, and an upper thicker segment 30 which extends upward into the lower portion of the pin tumbler housing and into cooperating relation with the top planar surface 24 of the recess. Such segment 30 carries a retaining lug 32 which, in the normal locked position of the control sleeve 26, extends laterally beyond the profile of the figure-8 shaped core body and into locking engagement with a core receptacle.

As shown in FIGS. 2 and 4, the core 10 is mounted in a core receptacle in the form of a cylinder 34 having a generally figure-8-shaped opening to receive it and having a notch 36 formed in its side wall to receive the retaining lug 32. The retaining lug 32 is shown in core-locking position, extending laterally beyond the profile of the core and into such notch 36 to lock the core against axial removal from the cylinder 34.

As shown in FIGS. 2 and 4, the pin tumbler barrels 14 extend from the pin tumbler housing 12 through the thick segment 30 of the control element 26 and into the key plug 20. The barrels contain pin segments 38 for locking the key plug and control element against rotation relative to the core body.

The control sleeve 26 and its control segment 30 are mounted for limited rotative movement in the core body 12, under control of the tumbler pins 38 in the tumbler barrels 14. The key plug 20 is mounted for rotation in the cylindrical portion 28 of the control element 26 and in the bore 18 of the key plug housing 16 and relative to both of such elements, also under the control of the pin tumblers 38 in the tumbler barrels 14. The inner cylindrical surface of the control element 26, together with the surface of the bore 18, defines an operating shear line at the cylindrical surface of the key plug 20, so that when shear faces in the pin tumbler stacks are brought to that shear line by the presence of a suitable key in the key plug, such key plug can be rotated freely to operate a secondary lock.

The outer face of the thick segment 30 of the control element has a central arcuate portion 40 on a radius of curvature about the axis of rotation of the sleeve, which in this embodiment is also the axis of rotation of the key plug 20. Such arcuate portion 40 of the surface extends from the central plane of the pin tumbler barrels, on the line 4—4 of FIG. 2, through a small angle which is desirably 15° in a standard core and may terminate at the position of the radius R shown in FIG. 2. Beyond this point, the control segment 30 is defined by a flat planar surface 42 which diverges from the arc of curvature C defined by the radius R, and which lies at an angle to the planar face 24 of the recess, such angle being substantially equivalent to the arcuate length of the arcuate surface portion 40.

At the opposite side of the central plane on the line 3—3, the thick control segment 30 is defined by a second flat planar stop surface 44 which, as shown, is tangent to the arcuate portion 40 at said central plane and extends outward from the point of tangency. In the core-locking position shown in FIG. 2, such projection stop face lies flat against a stop face portion 45 of the flat planar surface 24 of the recess.

The arcuate portion 40 of the top surface of the control segment 30 is movable in shearing relation with the planar top surface 24 of the recess 20 and defines a control shear line at that level. As shown in FIG. 4, such control shear line is traversed by two pin tumbler stacks, namely the second and third stacks from the front of the core. When a suitable control key 46 brings shear faces in those two pin tumbler stacks to that control shear line and not to the operating shear line therein, and shear faces to the operating shear line in the other pin tumbler barrels, the control element is then locked to the key plug 20 and can be rotated therewith through its limited angle of rotation from its normal locking position as shown in FIG. 2 to its released position shown in FIG. 3. This retracts the retainer lug 32 to within the profile of the core 10, so that the core can be axially withdrawn from the cylinder 34 or other receptacle. For purposes of limiting the lug-retracting rotation of the control element, the planar face 42 of such control segment 30 moves as a stop face against the confronting stop face portion 43 of the core face 24 to stop movement of the control element 30 in its lug-retracted position, shown in FIG. 3.

The presence of planar surface 42 on the control segment 30 and its divergence from the curvature C of the arcuate portion 40 on the radius R serves the further and important purpose of increasing the cross section and strength of the retaining lug 32 and its supporting structure. In FIG. 2, the material outward of the dotted curvature line C represents added material which increases the cross section and strength of the lug 32 and its supporting structure over what would be present in a standard core as shown, for example, in F. E. Best U.S. Pat. No. 3,206,958, where the outer face of the control segment is defined in its entirety by an arcuate surface on a constant radius of curvature about the center of rotation of the control element. Such added material and strength is sufficient to significantly increase the pull resistance of the core against forceful movement of the core from its receptacle by axial pulling, as with an impact hammer or pulling device secured to the key plug 20.

Operation of the embodiment shown in FIGS. 1–4 is analogous to that of a standard core. When the core is in its normal locked position, as shown in FIGS. 1, 2, and 4, the retaining lug 32 is in its projected position for engagement in the notch or behind a shoulder in the core receptacle, and the key plug 20 and control element 26 are both held against rotation by pin segments extending across the operating and shear lines to prevent rotation from their normal positions. Insertion of a suitable operating key in the key plug brings shear faces in the pin stacks to the operating shear line at the surface of the key plug 20 so that such key plug may be rotated to actuate a secondary lock. For removal and replacement of the core in its receptacle, a control key 46 is inserted in the key plug which actuates the pin stacks to bring shear faces to the control shear line in the two barrels 14 extending through the control element, and to the operating shear line in the other barrels 14. The control key can then be rotated to rotate the control element 26 and the key plug 20 from the position shown in FIG. 2 to the position shown in FIG. 3 where the retaining lug 32 is retracted to within the profile of the core so that the core can be withdrawn from its complementary chamber in the core receptacle.

The arrangement shown in FIGS. 1–4 is the preferred arrangement, in which the cylindrical portion 28 of the control element is substantially of the same thickness as the wall of the key plug housing 16 and extends axially across only two or three of the pin tumbler barrels 14, and in which the cooperating top face 24 of the recess containing the control element is a flat planar surface normal to the plane containing the axes of the two lobes of the core body. However, certain modifications may be made, for example, to further increase the cross-sectional area of the retaining lug 32 and its supporting structure, and/or to modify the means for stopping the limited rotation of the control element. Such changes are exemplified in FIG. 5. Here, the control element 126 has a thickened control segment 130 containing a series of pin tumbler barrel portions 114 and carrying a retaining lug 132. The control segment has a central arcuate surface portion extending clockwise from the central plane position of the pin tumbler barrels 114 to the radius R'. Outward therefrom, such control segment is defined at the top by a planar stop face 142 which diverges from the curvature of the arcuate portion 140 at a greater angle than the tangential surface 42 in FIG. 2, and thus defines a small angle with the tangent to such arcuate surface at the point of departure marked by the radius R'. Similarly, the stop face 143 on the pin tumbler housing 112 of the core is swung upward by a corresponding angle from the planar surface 24 of FIG. 2. The upward-swung position of the stop face 142 on the retaining lug 132 further increases the cross-sectional area of that lug and of its supporting structure. The retaining lug and the control segment 130 are shown in their lug-projected position in full lines in FIG. 5. From such position, the control element 126 is rotatable counterclockwise through a limited angle, desirably of about 15°, to carry the stop face 142 on the control element against the stop face 143 on the pin tumbler housing of the core, as indicated in dotted lines. The engagement of these two surfaces stops the rotation of the control element in its lug-retracted position.

FIG. 5 also shows a modification of the stop mechanism to the left of the pin tumbler barrels 114. The arcuate surface 140 which extends clockwise to the position of the radius R' is also extended counterclockwise past the position of the pin tumbler barrels 114 to the position of the radius R", to form an arcuate land 141. Beyond this point, the control segment 130 is defined by an upward inclined stop face 144. The overlying portion of the pin tumbler housing 112 is formed with a complementary shape, and thus includes a concave arcuate land 125 which lies in close clearance relation with the arcuate land 141 on the control segment. At the position of the radius R", such arcuate body land 125 is joined by a planar stop face 124, in position to be engaged by the planar stop face 144 on the control segment.

When the control element 126 is in its normal position, as shown in full lines in FIG. 5, the pin tumbler barrel portions 114 in the control segment 130 are aligned with the corresponding barrel portions in the pin tumbler housing 112. When the control element 126 is rotated counterclockwise to its lug-retracted position, the pin tumbler barrel portions in that segment move to the positions shown in dotted lines, where the pin tumblers 138 therein are substantially opposite to and bear against the arcuate land 125 on the pin tumbler housing 112. In this position, also as shown in dotted lines, the stop face 144 moves counterclockwise to the position shown in dotted lines. Such movement positions the control segment 130 and its retaining lug 132 wholly within the profile of the core. The position of the arcuate land 125 on the pin tumbler housing has the effect of positively trapping the pin segments 138 between itself and the control key.

Figure 7:
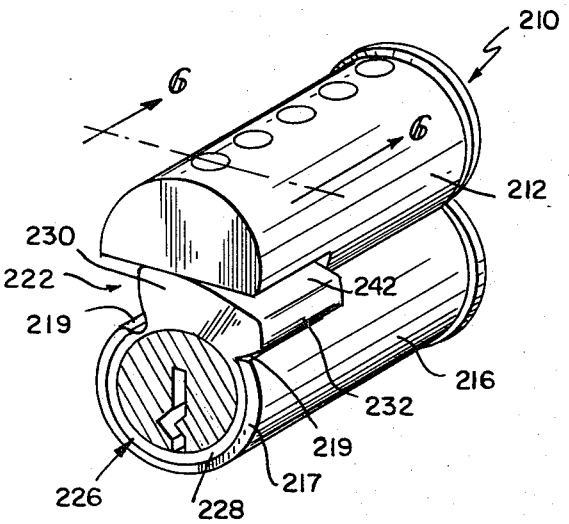
FIG. 7 is a rear perspective view of the modified core shown in FIG. 4.
Figure 6:
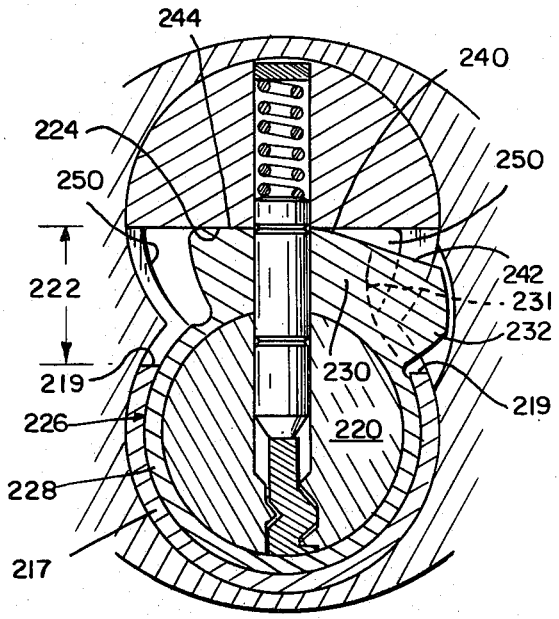
FIG. 6 is a transverse section of a modified embodiment, showing the use of a full-length thin-walled sleeve carrying a lug-supporting segment at the rear and disposed between the key plug and an outer wall of the bottom lobe of the core body.

A further modification is shown in FIGS. 6 and 7. The core 210 shown is similar to that shown in FIGS. 1–3, but differs in that the control segment 230 of the control element 226 has its retaining lug 232 at the rear of the plug, carried by a thin-walled sleeve 228 which may extend the full length of the key plug housing 216. The control segment 230 may have a narrower portion ahead of the retaining lug 232, indicated by the dotted line 231, which portion extends forward in a broached opening 250 in a manner analogous to that in a standard core as shown in U.S. Pat. No. 3,206,958. The lower lobe or key plug housing 216 of the core body is not completely cut through to receive the control element as in FIGS. 1–4, but instead has a transverse notch-like recess 222 cut into it from the rear, defined at the top by a flat planar face 224 and at the bottom by coplanar edges 219 of the wall of the lower lobe 216, which wall extends rearward in a thin section 217 to the rear of the core body. Over the length of the transverse recess 222, the circumferential extent of that wall section 217 is interrupted at the edges 219, and the transverse recess 222 defines a side opening through which the retaining lug 232 may project as in the standard core. The top face of the control segment 230 of the control element 226 is shaped as in FIG. 2, with a central arcuate portion 240, a lateral planar stop face 242 tangent to the arcuate surface 240, and at the opposite side a planar stop face 244 substantially tangent to such arcuate portion at its opposite edge.

Operation of the modification shown in FIGS. 6 and 7 is the same as that in FIGS. 1–4, except that when the control segment 230 extends the full length of the core body, it defines the control shear line over the full length of the body, and this provides that rotation of the control element requires alignment of pin-stack shear faces at that control shear line at all of the pin tumbler barrels. This permits the control key operation to be combinated in a greater number of combinations.

What is claimed is:

1. A key-removable lock core adapted to be retained in a core receptacle by a retainer lug retractable to within the profile of the core by key operation, having a core body forming a key-plug housing and a pin tumbler housing, a key plug supported for rotation in said key-plug housing, a control element having a retainer lug thereon and mounted in said key plug housing for limited rotation therein between a core-locking position in which the lug projects laterally from the core body outside its profile and a retracted position in which the control element and lug are within such profile, said control element having an inner cylindrical face defining an operating shear line between itself and the key plug and having an outer face defining a control shear line between itself and a face on said pin tumbler housing, a series of pin tumbler barrels extending from said pin tumbler housing through said control element and into said key plug, and said core having the improvement comprising a shear line-defining arcuate face portion on said outer face of the control element in the vicinity of said pin tumbler barrels, substantially on a radius of curvature about the axis of rotation of the control element, and a planar portion adjacent thereto and extending outward toward said retaining lug and diverging at a small angle from such curvature so that said control element and lug extend radially beyond such radius of curvature to increase the cross section of the lug, said face on said pin tumbler housing having a shear line-defining portion in the vicinity of said pin tumbler barrels and a lateral stop face against which said planar face of the control element moves as a stop when the control element is moved to core-retracted position, and stop means for stopping the control element when the control element is moved to core-locking position, said stop means comprising a stop face portion on the control element at the opposite side of said arcuate face portion from said planar portion, and a stop face on the core body against which such stop face portion moves when the control element is moved to core-locking position, said stop faces on the pin tumbler housing being at an angle to each other.

2. A core as in claim 1 in which said control element comprises a cylindrical sleeve portion surrounding the key plug.

3. A core as in claim 2 in which said sleeve is coaxial with the key plug.

4. A core as in claim 2 in which the core body is of figure-8 cross section with a lower lobe forming the key plug housing, said lobe being formed with a transverse recess intermediate its ends and said control element being mounted within said recess.

5. A key-removable lock core adapted to be retained in a core receptacle by a retainer lug retractable to within the profile of the core by key operation, having a core body forming a key-plug housing and a pin tumbler housing, a key plug supported for rotation in said key-plug housing, a control element having a retainer lug thereon and mounted in said key plug housing for limited rotation therein between a core-locking position in which the lug projects laterally from the core body outside its profile and a retracted position in which the control element and lug are within such profile, said control element having an inner cylindrical face defining an operating shear line between itself and the key plug and having an outer face defining a control shear line between itself and a face on said pin tumbler housing, a series of pin tumbler barrels extending from said pin tumbler housing through said control element and into said key plug, and said core having the improvement comprising a shear line-defining arcuate face portion on said outer face of the control element in the vicinity of said pin tumbler barrels, substantially on a radius of curvature about the axis of rotation of the control element, and a planar portion adjacent thereto and extending outward toward said retaining lug and diverging at a small angle from such curvature so that said control element and lug extend radially beyond such radius of curvature to increase the cross section thereof, said face on said pin tumbler housing having an arcuate shear line-defining portion complementary to the arcuate face of the control element in the vicinity of said pin tumbler barrels and a lateral stop face against which said planar face of the control element moves as a stop when the control element is moved to core-retracted position, and stop means for stopping the control element when the control element is moved to core-locking position, said core body being of figure-8 cross section with a lower lobe forming the key plug housing, said body being formed with a transverse slot at its rear end defined in part by said arcuate shear line-defining face portion of the pin tumbler housing, and the retaining lug of said control element being positioned in said slot and movable laterally therein as the control element is moved between its two positions.

6. A core as in claim 5 in which said control element comprises a thin-walled sleeve extending the full length of the core body about the key plug and within the lower lobe of the core body, and a thicker control segment carried by such sleeve.

7. A key-removable lock core adapted to be retained in a core receptacle by a retainer lug retractable to within the profile of the core by key operation, having a core body forming a key-plug housing and a pin tumbler housing, a key plug supported for rotation in said key-plug housing, a control element having a retainer lug thereon and mounted in said key plug housing for limited rotation therein between a core-locking position in which the lug projects laterally from the core body outside its profile and a retracted position in which the control element and lug are within such profile, said control element having an inner cylindrical face defining an operating shear line between itself and the key plug and having an outer face defining a control shear line between itself and a face on said pin tumbler housing, a series of pin tumbler barrels extending from said pin tumbler housing through said control element and into said key plug, and said core having the improvement comprising a shear line-defining arcuate face portion on said outer face of the control element in the vicinity of said pin tumbler barrels, substantially on a radius of curvature about the axis of rotation of the control element, and a planar portion adjacent thereto and extending outward toward said retaining lug and diverging at a small angle from such curvature so that said control element and lug extend radially beyond such radius of curvature to increase the cross section thereof, said face on said pin tumbler housing having a shear line-defining portion in the vicinity of said pin tumbler barrels and a lateral stop face against which said planar face of the control element moves as a stop when the control element is moved to core-retracted position, and stop means for stopping the control element when the control element is moved to core-locking position, and wherein the arcuate face portion of the control element has an arcuate land extending in the direction of movement of the control element toward its lug-retracting position from the position of the pin tumbler barrels, and the pin tumbler housing has a face land confronting such control element land in position to confine pin tumbler segments in the control element as it is so moved.

8. A core as in claim 7 in which said stop means is positioned outwardly of said lands.

9. A core as in claim 7 in which said stop means comprises a planar stop face extending outward from said land on the control element and a complementary stop face extending outward from said face land on the core body.

10. A key-removable lock core adapted to be retained in a core receptacle by a retainer lug retractable to within the profile of the core by key operation, having a core body of figure-8 cross section having upper and lower lobes forming a key-plug housing and a pin tumbler housing, said body having a transverse recess extending through the sides and rear of the lower lobe and having a top face in the lower part of the upper lobe, a key plug supported for rotation in said key-plug housing, a control element having a thick-walled lug segment with a retainer lug thereon, and having a cylindrical portion mounted in said recess in the key plug housing for limited rotation with the key plug between a core-locking position in which the lug projects laterally from the recess and outside the profile of the core and a retracted position in which the control element and lug are within such recess and profile, said control element having an inner cylindrical face defining an operating shear line between itself and the key plug and having an outer face on said thick-walled lug segment defining a control shear line between itself and said face on said upper lobe, a series of pin tumbler barrels extending from said pin tumbler housing through said control element and into said key plug, and said core including the improvement comprising a shear line-defining arcuate face portion on said outer face of said control element segment extending from said pin tumbler barrels toward said lug, substantially on a radius of curvature about the axis of rotation of the control element, and having a planar portion adjacent thereto and extending outward to said retaining lug and diverging at a small angle from such curvature, said face on said upper lobe having a shear line-defining portion and including a central concave arcuate portion complementary to the arcuate face portion on said control element in the vicinity of said pin tumbler barrels and having a lateral stop face against which said planar face of the control element moves as a stop when the control element is moved to core-retracted position, and stop means for stopping the control element when the control element is moved to core-locking position.

11. A key-removable lock core adapted to be retained in a core receptacle by a retainer lug retractable to within the profile of the core by key operation, having a core body of figure-8 cross section having upper and lower lobes forming a key-plug housing and a pin tumbler housing, said body having a transverse recess extending through the sides and rear of the lower lobe and having a top face in the lower part of the upper lobe, a key plug supported for rotation in said key-plug housing, a control element having a thick-walled lug segment with a retainer lug thereon, and having a cylindrical portion mounted in said recess in the key plug housing for limited rotation with the key plug between a core-locking position in which the lug projects laterally from the recess and outside the profile of the core and a retracted position in which the control element and lug are within such recess and profile, said control element having an inner cylindrical face defining an operating shear line between itself and the key plug and having an outer face on said thick-walled lug segment defining a control shear line between itself and said face on said upper lobe, a series of pin tumbler barrels extending from said pin tumbler housing through said control element and into said key plug, and said core including the improvement comprising a shear line-defining arcuate face portion on said outer face of said control element segment extending from said pin tumbler barrels toward said lug, substantially on a radius of curvature about the axis of rotation of the control element, and having a planar portion adjacent thereto and extending outward to said retaining lug and diverging at a small angle from such curvature, said face on said upper lobe having a shear line-defining portion in the vicinity of said pin tumbler barrels and a lateral stop face against which said planar face of the control element moves as a stop when the control element is moved to core-retracted position, and stop means for stopping the control element when the control element is moved to core-locking position, the upper lobe of said body including a longitudinal recess extending axially forward from said transverse recess, and said control element having a thick-walled portion extending forward from said lug segment and extending across at least one pin tumbler barrel beyond the axial extent of the lug.

12. A core as in claim 11 in which said transverse and longitudinal recesses extend substantially the full length of the core body and said thick-walled segments cross all pin tumbler barrels of the lock.

* * * * *